US010730716B2

(12) United States Patent
Heymann

(10) Patent No.: US 10,730,716 B2
(45) Date of Patent: Aug. 4, 2020

(54) DEVICE FOR EXTRUDING, STRETCHING, AND WINDING A GROUP OF FILM STRIPS

(71) Applicant: Oerlikon Textile GmbH & Co. KG, Remscheid (DE)

(72) Inventor: Frank Heymann, Chemnitz (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 1149 days.

(21) Appl. No.: 15/029,126

(22) PCT Filed: Sep. 25, 2014

(86) PCT No.: PCT/EP2014/070527

§ 371 (c)(1),
(2) Date: Apr. 13, 2016

(87) PCT Pub. No.: WO2015/055399

PCT Pub. Date: Apr. 23, 2015

(65) Prior Publication Data

US 2016/0251194 A1 Sep. 1, 2016

(30) Foreign Application Priority Data

Oct. 14, 2013 (DE) ..... 10 2013 016 980

(51) Int. Cl.
*B65H 54/20* (2006.01)
*B65H 54/44* (2006.01)
(Continued)

(52) U.S. Cl.
CPC ..... *B65H 54/20* (2013.01); *B65H 54/44* (2013.01); *B65H 54/553* (2013.01); *B65H 57/16* (2013.01);
(Continued)

(58) Field of Classification Search
CPC ..... B65H 54/20; B65H 54/44; B65H 54/553; B65H 57/16; B65H 67/0405;
(Continued)

(56) References Cited

U.S. PATENT DOCUMENTS 3,977,621 A * 8/1976 Huffman ..... B65H 18/103 242/413.5
4,993,650 A 2/1991 Nickell
(Continued)

FOREIGN PATENT DOCUMENTS

DE 2541761 A1 3/1977
DE 3344645 A1 6/1985
(Continued)

OTHER PUBLICATIONS

Third Party Observation submitted to the PCT on Dec. 17, 2015, for International Application No. PCT/EP2014/070527 filed Sep. 25, 2014, 7 pages.

*Primary Examiner* — Joseph S Del Sole
*Assistant Examiner* — Jamel M Nelson
(74) *Attorney, Agent, or Firm* — BainwoodHuang

(57) ABSTRACT

Techniques involve extruding, orienting and winding up a skein of film tapes or monofilaments. In particular, an apparatus has an extrusion installation, a plurality of drawing-off rollers and orienting rollers and a multiplicity of winding positions which are held alongside one another and one above another on an operating side of a frame wall. The winding positions are configured such that the wound packages are kept ready for removal at the frame wall on a doffing side on the opposite side from the operating side. Such an apparatus is able to achieve a material flow that is as continuous as possible during the production of the film strips and monofilaments.

13 Claims, 9 Drawing Sheets

Figure 1:
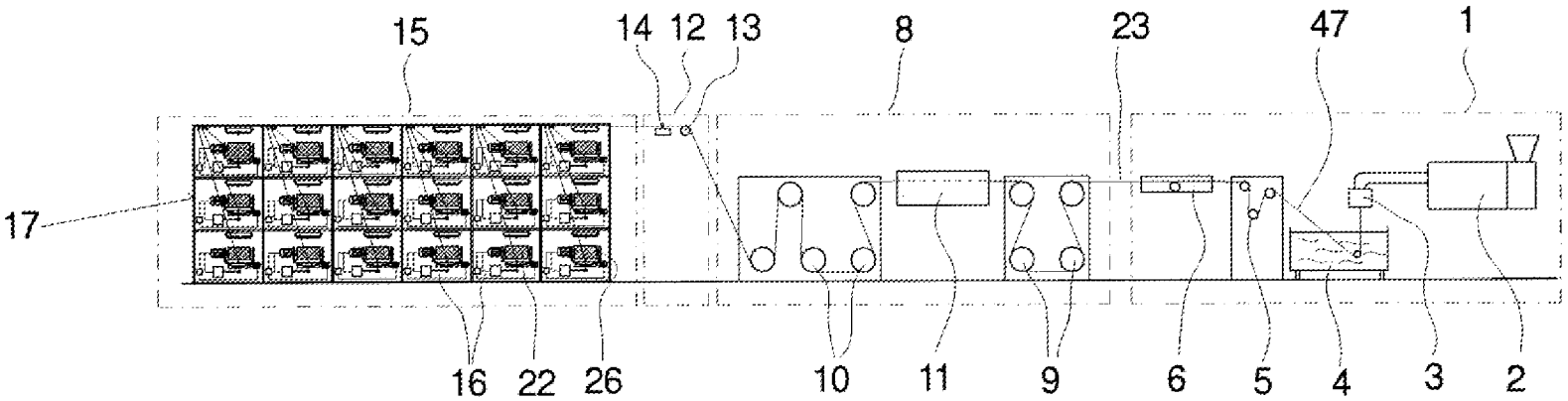

(51) Int. Cl.
*B65H 54/553* (2006.01)
*B65H 57/16* (2006.01)
*B65H 67/04* (2006.01)

(52) U.S. Cl.
CPC . *B65H 67/0405* (2013.01); *B65H 2701/3132* (2013.01)

(58) Field of Classification Search
CPC ..... B65H 2701/3132; B65H 54/02; B65H 54/10; B65H 54/5658; B65H 54/585
See application file for complete search history.

(56) References Cited

U.S. PATENT DOCUMENTS

| | | | | |
|---|---|---|---|---|
| 6,405,968 | B2 * | 6/2002 | Flamm | B65H 54/52 242/473.4 |
| 6,439,498 | B1 | 8/2002 | Hufschmidt et al. | |
| 6,902,131 | B1 | 6/2005 | Jelinek et al. | |
| 2009/0088307 | A1 * | 4/2009 | Jelinek | B05C 17/0207 492/29 |
| 2012/0139150 | A1 * | 6/2012 | Behnert | D01D 5/423 264/146 |

FOREIGN PATENT DOCUMENTS

| | | | | |
|---|---|---|---|---|
| DE | 19801150 | A1 | 8/1998 | |
| DE | 19962296 | A1 | 6/2001 | |
| DE | 10234554 | A1 | 2/2004 | |
| DE | 102005049163 | A1 | 5/2006 | |
| DE | 102009048611 | A1 | 4/2011 | |
| DE | 102009048611 | A1 * | 4/2011 | B65H 54/543 |
| EP | 1159217 | A1 | 12/2001 | |
| EP | 1178139 | A2 | 2/2002 | |
| EP | 1184320 | A2 | 3/2002 | |
| EP | 1566474 | A2 * | 8/2005 | D02G 1/0266 |
| EP | 1566474 | A2 | 8/2005 | |
| EP | 2336064 | A2 | 6/2011 | |
| EP | -1838908 | B1 * | 7/2012 | D01D 5/08 |
| EP | 1838908 | B1 * | 7/2012 | D01D 5/08 |
| EP | 2573016 | A2 | 3/2013 | |
| WO | 03/091140 | A1 | 11/2003 | |
| WO | WO-03091140 | A1 * | 11/2003 | B65H 54/88 |
| WO | 2006069642 | A1 | 7/2006 | |
| WO | WO-2006069642 | A1 * | 7/2006 | D01D 5/08 |
| WO | 2007/038970 | A1 | 4/2007 | |

* cited by examiner

DEVICE FOR EXTRUDING, STRETCHING, AND WINDING A GROUP OF FILM STRIPS

The invention relates to an apparatus for extruding, orienting and winding up a skein of film tapes or monofilaments as disclosed herein and to a winding position apparatus in particular for use in such an apparatus as disclosed herein.

In order to produce film tapes, it is known that a film is extruded from a thermoplastic material, said film preferably being cut as a flat film into a multiplicity of film tapes. Subsequently, the skein of film tapes is guided over a plurality of drawing-off rollers and orienting rollers, which orient the film tapes. Finally, the film tapes are separated out and each wound to form packages by a multiplicity of winding positions.

An apparatus of the generic type is known for example from U.S. Pat. No. 6,439,498 B1. In the known apparatus, a plurality of winding positions are held one above another and alongside one another at a frame wall. The winding positions each have a projecting winding spindle, a winding tube being fittable on the free end of said winding spindle. Each winding position held at the frame wall is fed one of the film tapes, which are wound to form a package within the winding position. As soon as a package has been fully wound, a manual package change is carried out by an operator, who removes the full package from the spindle with an auxiliary installation and feeds a new tube to the winding position. Therefore, the winding positions are operated and the full packages are transported away on an operating side of the frame wall. In the case of a multiplicity of winding positions at a frame wall, collisions between operation and transporting away are thus unavoidable.

Therefore, it is the object of the invention to develop an apparatus for extruding, orienting and winding up a skein of film tapes or monofilaments such that a continuous process is ensured while the skein of tapes is being wound up.

A further aim of the invention is to provide a winding position apparatus which allows a continuous winding process with little operating effort.

This object is achieved by an apparatus having features disclosed herein and by a winding position apparatus having features disclosed herein.

Advantageous developments of the invention are defined by the features and combinations of features disclosed herein.

The apparatus according to the invention for extruding, orienting and winding up a skein of film tapes or monofilaments is distinguished by the fact that it is possible to transport packages away independently of the operation of the winding positions. To this end, the winding positions are configured such that the wound packages are kept ready for removal at the frame wall on a doffing side on the opposite side from the operating side. As a result of the physical separation between the operating side and the doffing side, collisions are ruled out in case of a plurality of winding positions.

The transporting away of the fully wound packages can advantageously be further improved in that a doffing aisle is assigned to the winding positions on the doffing side. Thus, it is possible to employ automated removal devices in order to transport the packages away.

In order to make it easier to operate the winding positions at the start of the process, an operating aisle is assigned to the winding positions on the operating side of the frame wall. In this way, rapid operability can be ensured even in the event of process interruptions on account of individual tape breaks.

In order to allow operation and transporting away of the packages independently of one another within the winding positions, according to an advantageous development of the invention, provision is made for the winding positions each to have a movable package holder, being pivotable between the operating side and the doffing side, for receiving a winding tube. In this way, the winding tube can be wound up with a thread on the operating side and can then be deposited as a package on the doffing side by pivoting the package holder.

To this end, the winding positions on the doffing side of the frame wall each have a package shelf device such that at least one or more packages can be kept ready for removal on the doffing side of the frame wall.

In order to obtain a continuous winding process with as little operating effort as possible, provision is furthermore made for the winding positions on the doffing side of the frame wall each to have a tube storage device with an output opening toward the operating side, by means of which empty tubes for dispensing to the package holder being kept ready. Thus, an automated package change is able to be carried out. In order to guide the tapes or monofilaments with as few auxiliary installations as possible, provision is furthermore made of the variant of the invention in which the winding positions on the operating side each have a position traversing device with a traversing thread guide that is driven in an oscillating manner, which guides at least one film tape or a monofilament during a package winding phase and during a package changing phase. Thus, the traversing thread guide can be guided in a holding position in the package changing phase for example, it remaining in said holding position during the package changing operation.

In order to be able to continuously receive the film tapes or monofilaments even in the event of a package change, the development of the invention in which the winding positions each have a suction device for receiving at least one of the film tapes or monofilaments, and in which the suction devices of the winding positions are connected to a processing device for recycling a film or filament material, is particularly advantageous. In this way, the material sucked-off during a package change can be fed to recycling. Advantageously, material waste is avoided.

The winding position apparatus according to the invention is distinguished by the fact that the winding tube can be driven or braked on the movable package holder depending on the function and the position of the package holder. Thus, the package holder can be moved back and forth between a package shelf with a braked winding tube and a thread run-in side with a driven winding tube in order to wind a package. The clamping plate on the package holder, said clamping plate being drivable in order to transmit the torque, is preferably driven via a belt drive in order to be held in as compact a manner as possible within a frame wall having a plurality of winding positions alongside one another. To this end, an electric motor can be arranged on the package holder parallel to the winding tube, in order to drive the belt drive positioned on the outer side of the package holder.

While film tapes and monofilaments are being wound up, it is necessary for predetermined crossing ratios to be maintained during the winding of the cross-wound package. To this end, the development of the winding position according to the invention in which a position traversing apparatus having a position traversing drive for driving a traversing thread guide is provided, and in which the traversing drive and the package drive are coupled together by an electronic control gearing, is particularly advantageous. In this way, a precision cross-wound package having predetermined crossing angles which are determined by the ratio of the winding circumferential speed and the traversing frequency can be wound. The traversing drive can advantageously be embodied by a reversing thread shaft and an electric motor. However, in principle, the traversing drive could also be formed by a belt drive and an electric motor.

Since the individual tapes are fed from the skein of tapes, it is necessary to ensure that uniform cross-wound packages are windable. To this end, the package drive is coupled to a dancer arm controller installation. This ensures that the film tape or the monofilament is wound with uniform tensile stress to form the package.

In order as far as possible to be able to carry out an automated package change, provision is furthermore made for one of the clamping plates to have a catching device which interacts with at least one auxiliary installation for catching and commencing winding. In this way, a film tape received continuously in a suction device can be fed to the catching device on the clamping plate, so that it is possible to catch and separate the tape without manual support.

Figure 2:
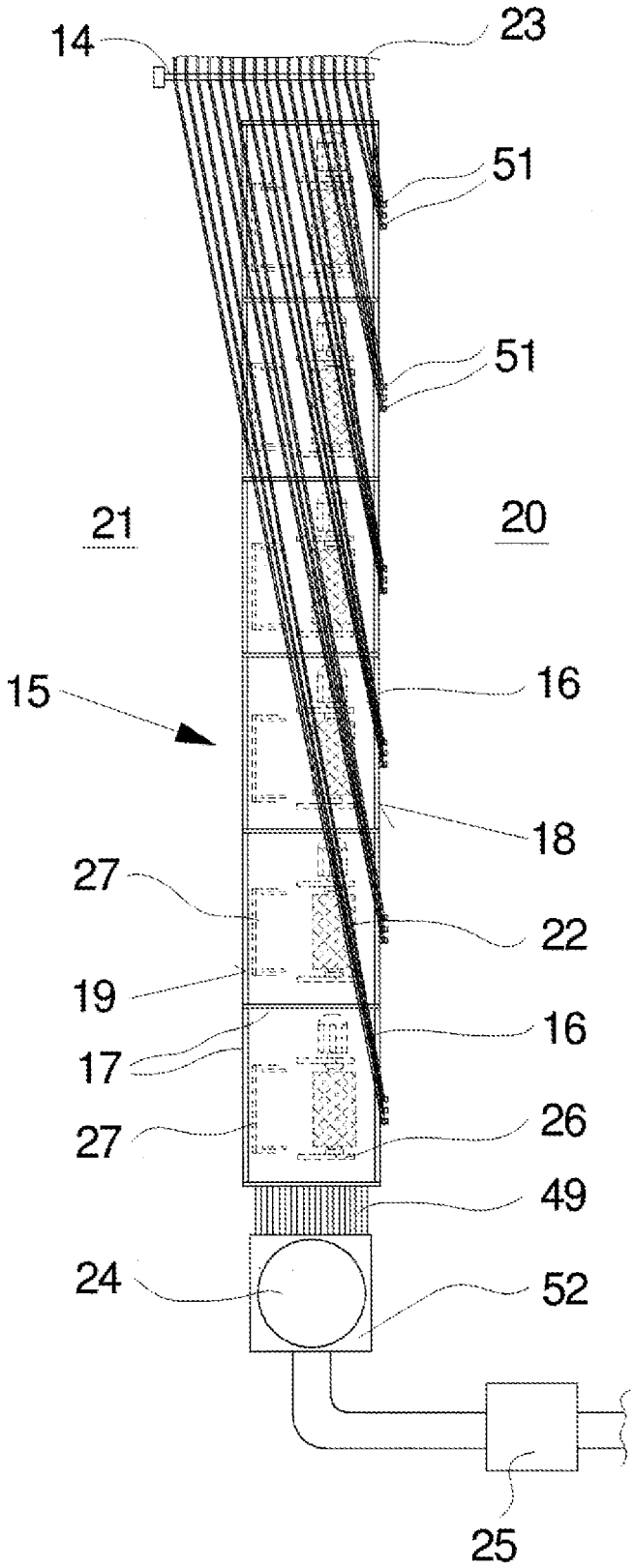
Figure 3:
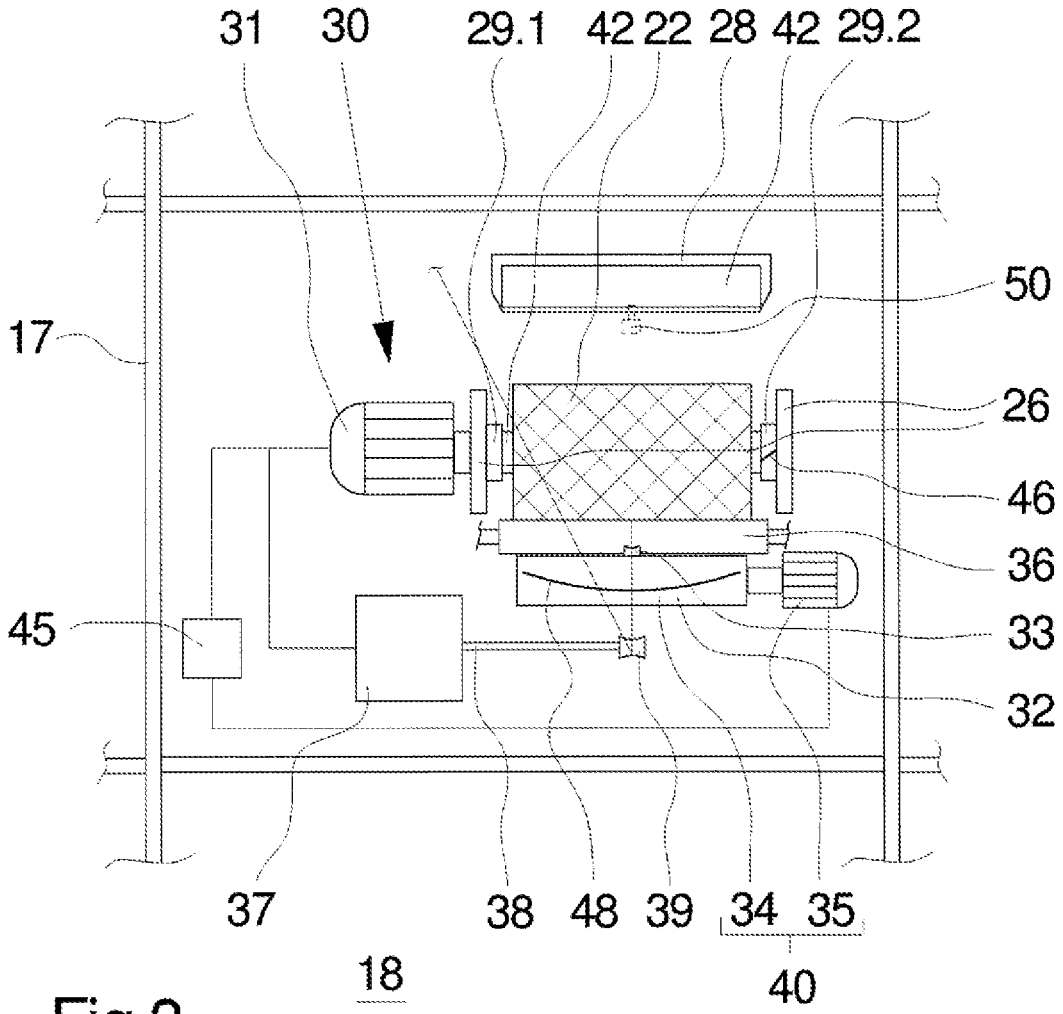
Figure 4:
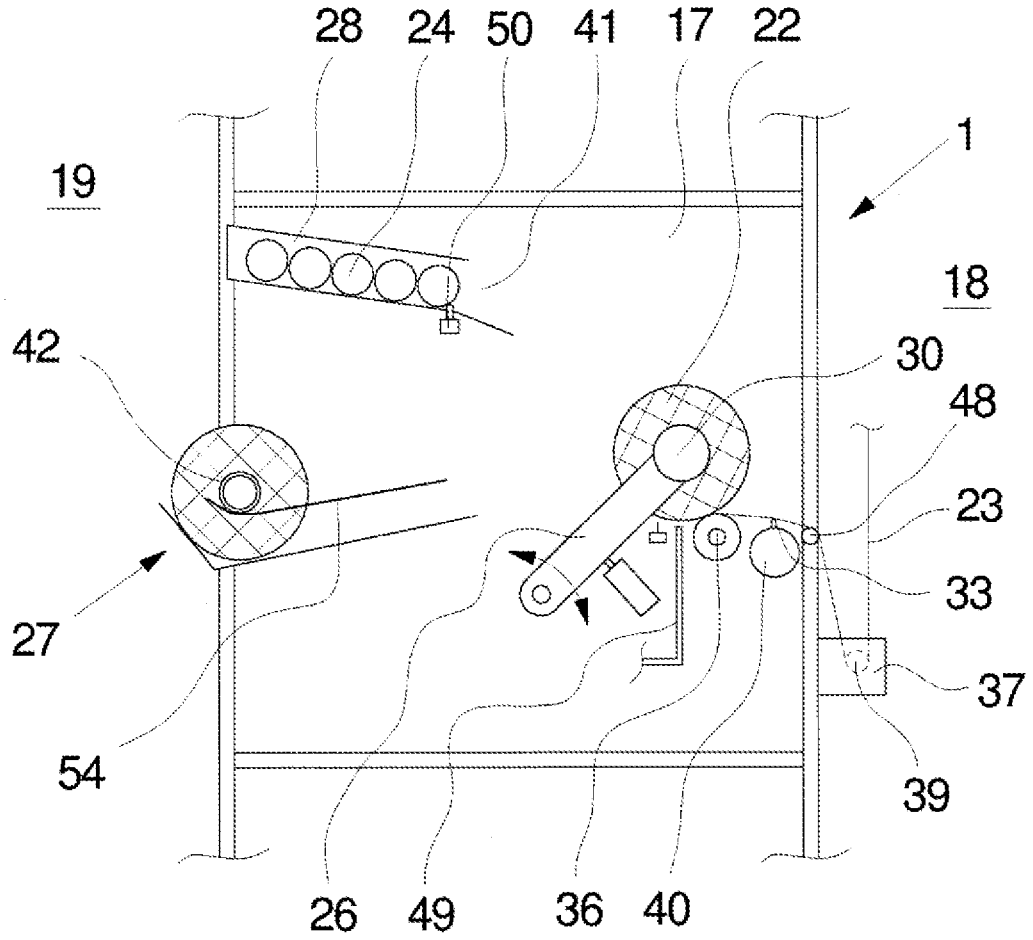
Figure 5:
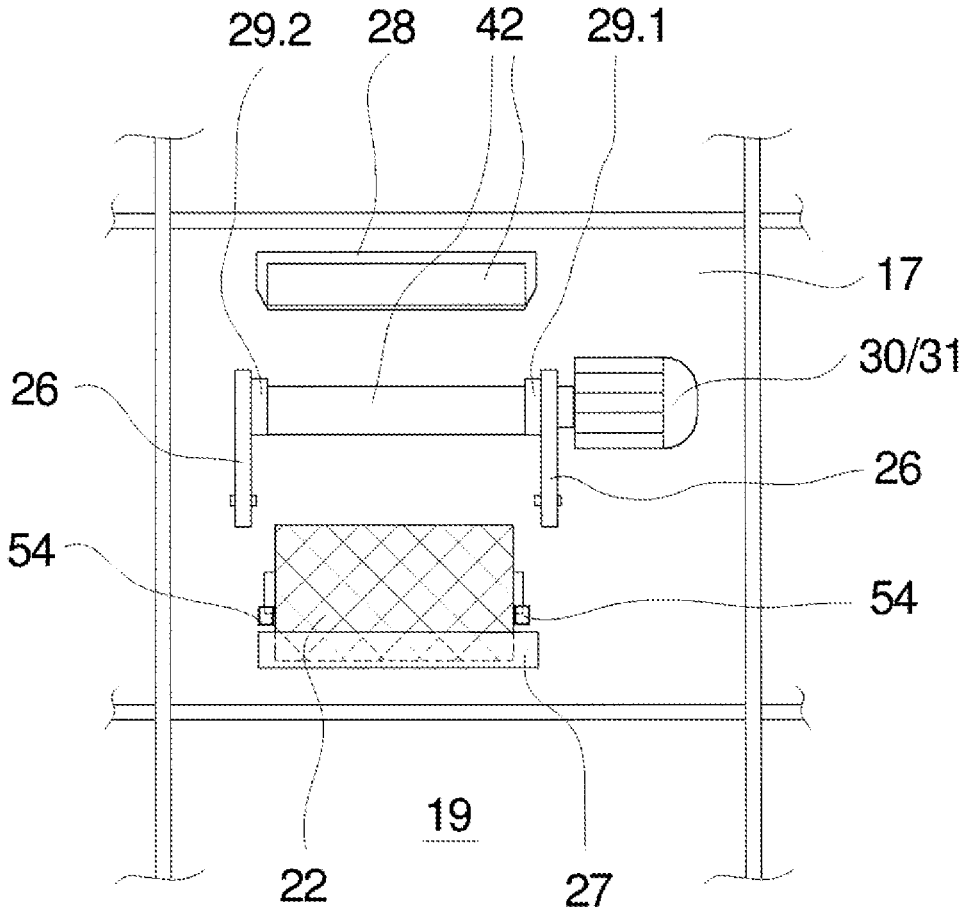
Figure 6:
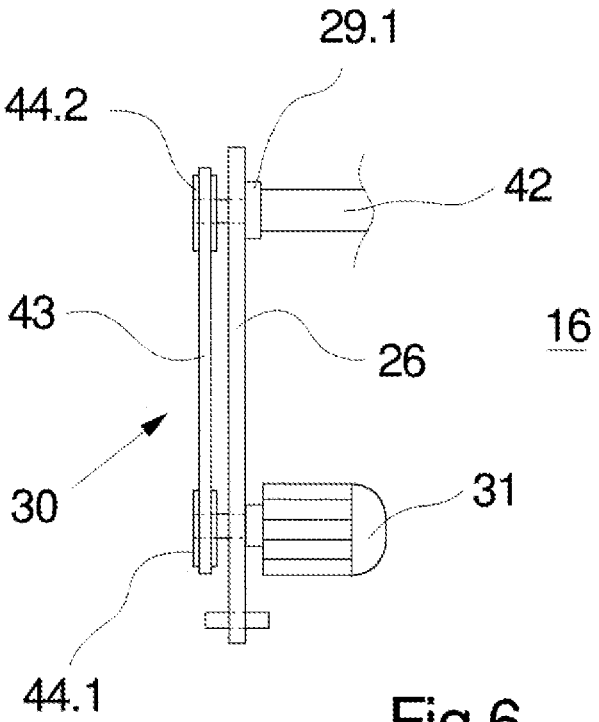
Figure 7:
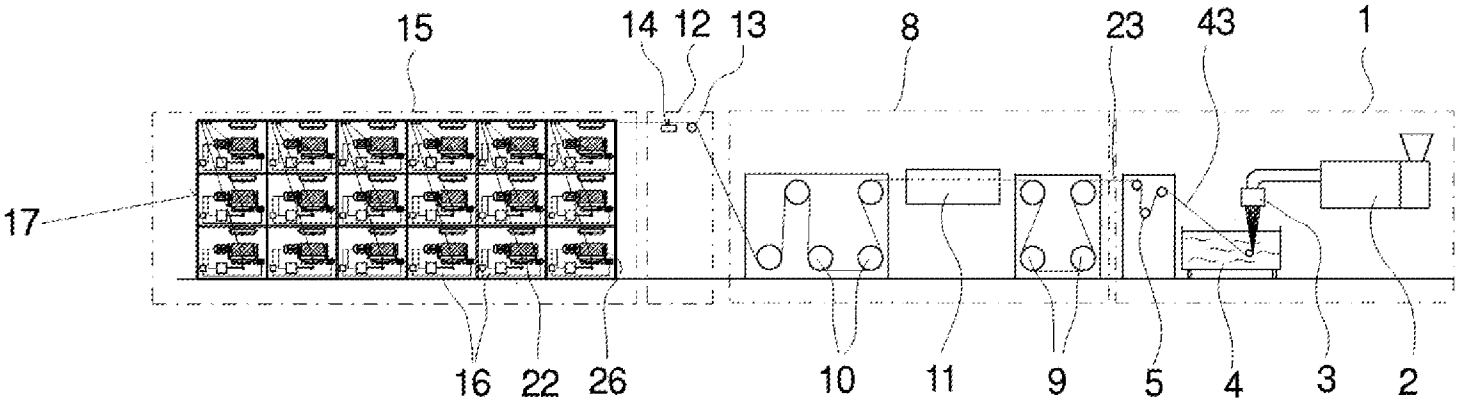
Figure 8:
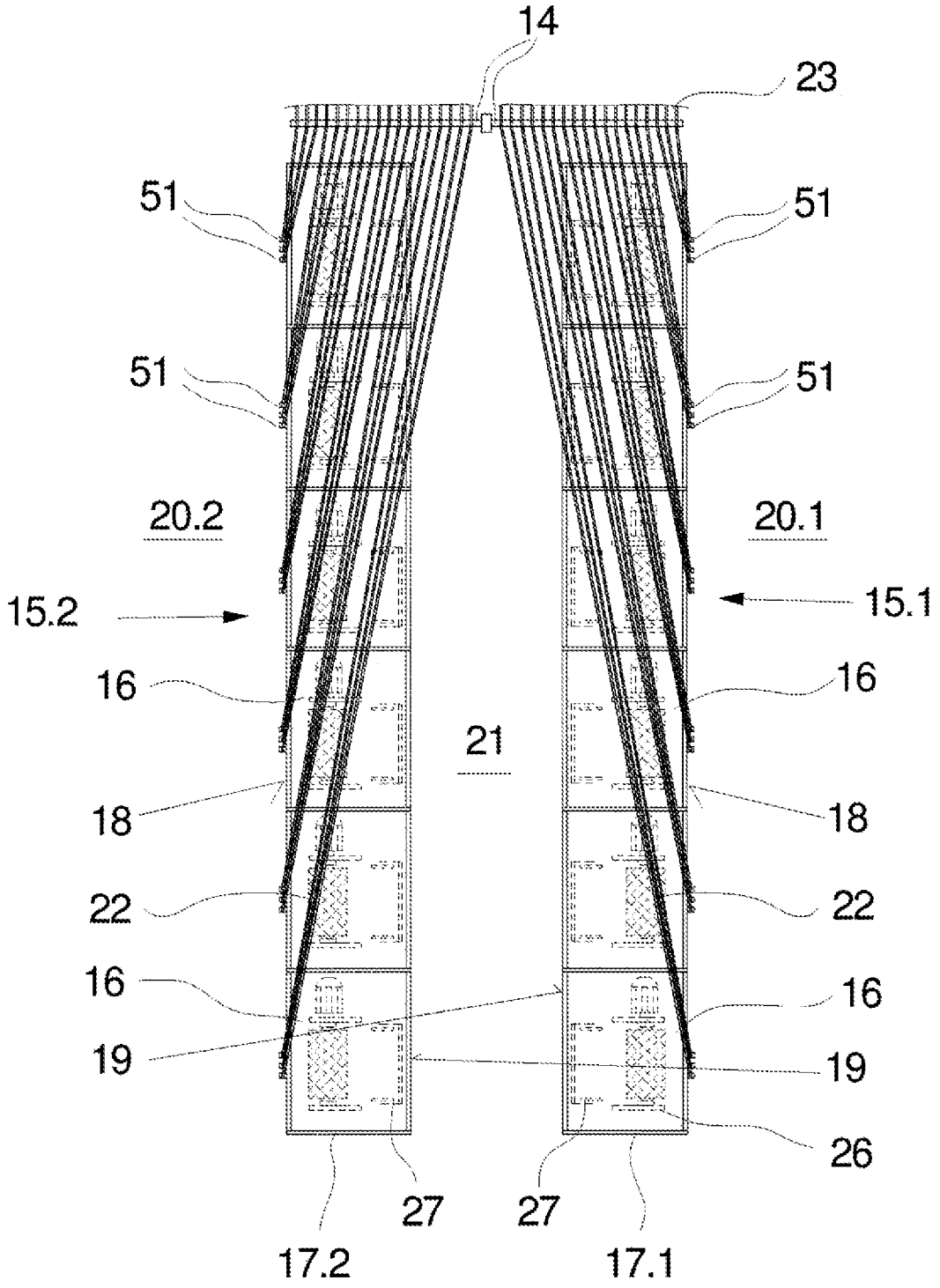
Figure 9:
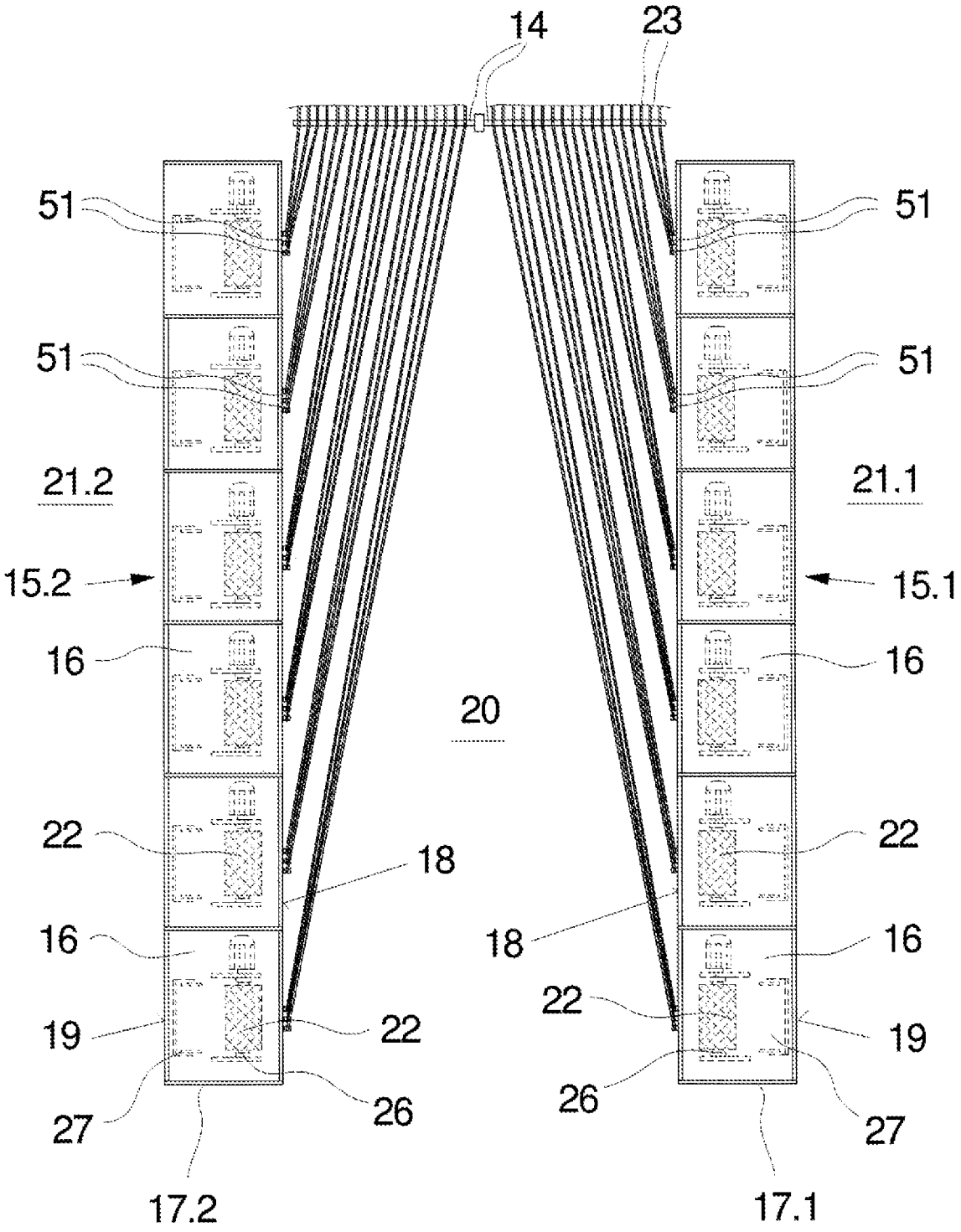

The apparatus according to the invention for extruding, orienting and winding up a skein of film tapes or monofilaments and the winding position apparatus are explained in more detail in the following text by way of a number of exemplary embodiments with reference to the appended figures, in which:

FIG. 1 schematically shows a view of a first exemplary embodiment of the apparatus according to the invention, FIG. 2 schematically shows a partial plan view of the exemplary embodiment of the apparatus according to the invention from FIG. 1, FIG. 3 schematically shows a front view of an exemplary embodiment of a winding position apparatus, FIG. 4 schematically shows a side view of the exemplary embodiment from FIG. 3, FIG. 5 schematically shows a rear view of the exemplary embodiment from FIG. 3, FIG. 6 schematically shows a partial view of an exemplary embodiment of a winding position apparatus, FIG. 7 shows a schematic view of a further exemplary embodiment of the apparatus according to the invention, FIG. 8 schematically shows a partial plan view of the exemplary embodiment of the apparatus according to the invention from FIG. 7, FIG. 9 schematically shows a partial plan view of a further exemplary embodiment of the apparatus according to the invention.

FIGS. 1 and 2 illustrate a plurality of views of a first exemplary embodiment of the apparatus according to the invention for extruding, orienting and winding up a skein of film tapes. FIG. 1 shows an overall view of the exemplary embodiment and FIG. 2 shows a detail of a plan view.

As is apparent from the illustration in FIG. 1, the exemplary embodiment has an extrusion installation 1, an orienting installation 8, a separating installation 12 and a winding-up installation 15, which are arranged horizontally one after another so as to form a thread run and produce a multiplicity of film tapes in a one-stage process.

In this exemplary embodiment, the extrusion installation 1 is formed by an extruder 2 and an extrusion head 3 connected to the extruder 2. Provided beneath the extrusion head 3 is a cooling bath 4 which is filled with a cooling fluid. A run-out side of the cooling bath 4 is adjoined by a deflection installation 5 and a cutting installation 6.

Within the extrusion installation 1, a base polymer, for example a polyethylene, is melted and fed to the extrusion head 3 under pressure as a melt. At the extrusion head 3, a flat film 47 is extruded and cooled in the cooling bath 4.

The film 47 is drawn off by the orienting installation 8, which comprises a plurality of drawing-off rollers 9 and a plurality of orienting rollers 10. To this extent, the drawing-off forces for drawing off the film 47 are generated via the drawing-off rollers 9.

Before the film 47 is fed to the orienting installation 8, the film 47 is dried by the deflection device 5 and the film 47 is split up into a multiplicity of individual film tapes 23 via the cutting installation 6. To this extent, the film tapes 23 are guided to the orienting installation 8 together as a skein of tapes.

Arranged between the drawing-off rollers 9 and the orienting rollers 10 is a heating installation 11 by way of which a thermal treatment of the film tapes 23 takes place. The orienting rollers 10 are driven at a greater circumferential speed than the drawing-off rollers 9, and so the film tapes 23 are oriented.

The orienting installation 8 illustrated in FIG. 1 is illustrated by way of example with only two rolling units. In principle, such orienting installations 8 can have a plurality of orienting zones, wherein the orienting zones could also be assigned a shrinkage zone in which it would be possible to carry out a shrinkage treatment in order to reduce tensions in the film tapes 23.

Arranged between the orienting installation 8 and the winding-up installation 15 is a separating installation 12. The separating installation 12 has a deflection roller 13 and a guide bar 14. The guide bar has a multiplicity of guide elements in order to separate the film tapes 23.

The winding-up installation 15 has a multiplicity of winding positions 16 which are arranged at a frame wall 17 in rows alongside one another and in levels one above another. Thus, in this exemplary embodiment, in each case three winding positions 16 are arranged one above another and seven winding positions are arranged alongside one another. The number of winding positions is by way of example. The winding positions 16 are embodied in an identical manner at the frame wall 17 and each have a package holder 26 in order to be able to wind a package 22 from each film tape 23. The package axes are aligned parallel to the frame wall such that the package holder mounted pivotably within the winding position can be moved back and forth within the frame wall between an operating side and a doffing side.

FIG. 2 shows a plan view of the winding-up installation 15 in order to clarify the alignment of the winding positions 16. As is apparent from the illustration in FIG. 2, the frame wall 17 has an operating side 18 and a doffing side 19 on the opposite side. The operating side 18, on which the film tapes 23 are fed to the winding positions 16, is assigned an operating aisle 20. A doffing aisle 21 extends on the opposite doffing side 19. Each of the winding positions 16 has a package shelf device 27 on the doffing side 19, such that the fully wound packages are transferred to the package shelf device 27 by the package holder 26 being pivoted. The package shelf devices 27 are designed to receive at least one package or a plurality of packages, such that the packages 22 can be removed from the doffing side 19 and transported away via the doffing aisle 21. The packages 22 can be removed and transported away both manually by an operator and in an automated manner by a doffer.

On the opposite operating side 18, the winding positions 16 are operated at the start of the process or after a tape breaks. To this end, an operator will carry out the respective separation and distribution of the film tapes 23 from the operating aisle 20.

The film tapes are guided as a skein to the guide bar 14 and fed to the winding positions 16. The guide bar 14 is positioned upstream of the frame wall 17, wherein the skein of tapes is guided above the frame wall 17. However, in principle, it is also possible to arrange the frame wall 17 in an offset manner with respect to the upstream orienting installation 8, such that the guide bar 14 is held above the operating aisle 20 and the film strips 23 are fed to the winding positions 16 from the operating aisle 20.

The winding positions 16 are configured in an identical manner at the frame wall 17, and so the structure and function of the winding positions 16 are described in more detail in the following text using an example of one of the winding positions. To this end, reference is made to FIGS. 3, 4 and 5, which illustrate a plurality of views of one of the winding positions 16. FIG. 3 shows the winding position from a front side, which corresponds to the operating side 18 at the frame wall 17. FIG. 4 shows a cross-sectional view and FIG. 5 shows a rear view of the winding position 16, wherein the rear view corresponds to the doffing side 19 of the frame wall 17. Where reference is not expressly made to one of the figures, the following description of the winding position 16 applies to all the figures.

The winding position 16 has a pivotable package holder 26 which is configured in a fork-like manner and is mounted on a pivot axle (not illustrated in more detail here). Arranged at the free ends of the package holder 26 are two opposite clamping plates 29.1 and 29.2. One of the clamping plates 29.1 or 29.2 is held in a movable manner on the package holder 26 to clamp a winding tube, such that in operation a winding tube 42 for receiving a package 22 is clamped between the clamping plates 29.1 and 29.2.

The clamping plate 29.1 is mounted in a rotatable manner on the package holder 26 and coupled directly to a package drive 30. In this case, the package drive 30 is formed by an electric motor 31 on the motor shaft of which the clamping plate 29.1 is fastened.

On the operating side 18 of the frame wall 17, the package holder is assigned a freely rotatable support roller 36 and a position traversing apparatus 32 with a traversing thread guide 33 that is driven in an oscillating manner. The traversing thread guide 33 is coupled to a traversing drive 40 which drives the traversing thread guide 33 in an oscillating manner. The traversing drive 40 is formed in this exemplary embodiment by a reversing thread shaft 34 and a motor 35. The reversing thread shaft 34 has a guide groove which interacts with a linear guide (not illustrated in more detail here) in order to guide the traversing thread guide 33 back and forth within a traversing stroke.

A film tape 23 is fed via a deflection roller 39 and an arcuate guide rod 48. The deflection roller 39 is held at the free end of a movable dancer arm 38 of a dancer arm controller installation 37. The dancer arm controller installation 37 is coupled to the package drive 30. In this way, the film tape 23 can be wound to form a package 22 with a substantially constant winding-up tension.

In order to be able to wind up the film tape 23 to form a precision cross-wound package, provision is made of an electronic control gearing 45 which couples the package drive 30 to the traversing drive 40. Thus, predetermined crossing angles can be maintained during the deposition of the film tape 23 on the surface of the package 22 throughout the winding run.

In order to be able to carry out an as far as possible automated package change in the winding position 16, the winding position 16 has a package shelf device 27 on the doffing side 19 of the frame wall 17. The package shelf device 27 is formed in this exemplary embodiment by two guide rails on which the ends of the winding tubes 42 are guided. As is apparent from the illustration in FIG. 4, the package shelf device 27 is suitable for keeping at least one package 22 ready for removal. In principle, the package shelf device 27 could also be suitable for receiving a plurality of packages. To this end, the package holder 26 with the fully wound package 22 is pivoted from the operating side 18 to the doffing side 19. By opening one of the clamping plates 29.2, the package can thus be delivered to the package shelf device 27.

In order to end a winding operation, the winding position 16 has at least one auxiliary installation for guiding the running tape in order to ensure that the film tape 23 is separated and drawn off. To this end, the winding position 16 has a suction nozzle 49 which is coupled to a suction device 24 (not illustrated here). The suction nozzle 49 is illustrated schematically in FIG. 4. The suction nozzle 49 usually interacts with a cutting installation in order to cut the film tapes 23 wound by the package 22.

In order to start a new winding operation, the package holder 26 is assigned a tube storage device 28 which stores a plurality of winding tubes 42. The tube storage device 28 has a controllable actuator 50 by way of which a winding tube 42 is fed to the package holder 26. The new winding tube 42 is clamped between the clamping plates 29.1 and 29.2 and subsequently driven to a predetermined circumferential speed via the package drive 30. As soon as the circumferential speed of the winding tube has been reached, the package holder 26 is pivoted back into its operational position on the operating side 18. During the package change, the film tape 23 is guided in the traversing thread guide 33, wherein the traversing thread guide 33 is preferably stopped during a package changing phase.

In order to catch and commence winding of the film tapes 23 guided continuously into the suction nozzle 49, the film tape is fed to the clamping plate 29.2, which has a catching device 46 as illustrated in FIG. 3. The catching device 46 has at least one clamping and cutting means in order to be able to wind the film tapes 23 on the circumference of the winding tube 42. To this extent, continuous winding-up operation of the winding position 16 is possible.

As is apparent from the illustration in FIG. 2, the film tapes are separated at the frame wall 17 by a plurality of guide pins 51 and are fed to the individual winding positions 16. In order to be able to feed the film tapes continuously sucked-off during a package change to recycling, the suction apparatus 24 is coupled to a processing installation 25. In this way, all of the suction nozzles 49 lead jointly into a catching container 52 which is connected to the processing installation 25. The processing installation 25 guides the tape waste 23 back to the extrusion installation 1 following processing.

In order in particular to obtain a structure of the winding positions 16 within the frame wall 17 that is as compact as possible, FIG. 6 illustrates a further embodiment variant of a winding position apparatus 16. In this case, only the package drive 30 is shown in a view in FIG. 6, since the remaining components of the winding position 16 are identical to the abovementioned exemplary embodiment.

In the exemplary embodiment of the winding position 16 illustrated in FIG. 6, the electric motor 31 is arranged on an inner side of the package holder 26 together with the clamping plate 29.1 to be driven. A belt drive 43 is formed on the opposite side of the package holder 26. To this end, the belt drive has two pulleys 44.1 and 44.2, wherein the pulley 44.1 is coupled directly to a motor shaft of the electric motor 31 and the pulley 44.2 is coupled directly to the clamping plate 29.1. To this extent, a small pitch of the winding position can be realized. The traversing drive (not illustrated here) could be formed in this case by an internal motor which is integrated within the reversing thread shaft.

FIG. 7 schematically illustrates a further exemplary embodiment of the apparatus according to the invention for extruding, orienting and winding up monofilaments. The structure and the function of the exemplary embodiment are substantially identical to the exemplary embodiment according to FIG. 1, and so, in order to avoid repetitions, only the differences are explained at this point and otherwise reference is made to the abovementioned description.

In the exemplary embodiment illustrated in FIG. 7, an extrusion installation 1, an orienting installation 8, a separating installation 12 and a winding-up installation 15 are arranged one after another so as to form a thread run. The orienting installation 8 and the separating installation 12 are configured in an identical manner to the abovementioned exemplary embodiment according to FIG. 1, and so reference is made to the abovementioned description.

In the extrusion installation 1, the extruder 2 is connected to a spinning head 7. The spinning head 7 is assigned a cooling bath 4 on its underside. The spinning head 7 has on its underside a multiplicity of nozzle openings through each of which a monofilament 53 is extruded. To this extent, a multiplicity of monofilaments 53 are extruded via the spinning head 7 from the polymer melt produced by the extruder 2 and are fed to the cooling bath 4. The monofilaments 53 are drawn off as a skein of threads by the orienting installation 8 via the deflection installation 5. At the deflection installation 5, the monofilaments 53 are dried. To this end, the deflection installation 5 has at least one suction means (not illustrated in more detail here) for discharging the residual liquid. After the monofilaments 53 have been oriented, the skein of monofilaments 53 is divided into two groups via the separation installation 12, said groups each being fed to a winding-up installation 15.1 and 15.2.

In the apparatus illustrated in FIG. 1, the winding-up installation 15 is formed by a plurality of winding positions 16 within a frame wall 17. In the exemplary embodiment according to FIG. 7, the number of winding positions is doubled by two winding-up installations 15.1 and 15.2 that are formed in a mirror-symmetrical manner. Such a winding-up installation is illustrated in FIG. 8. The winding-up installations 15.1 and 15.2 that are formed in a mirror-symmetrical manner with respect to one another each have a frame wall 17.1 and 17.2. Each of the frame walls 17.1 and 17.2 holds a plurality of winding positions 16. The frame walls 17.1 and 17.2 are located with their doffing sides 19 opposite one another so that the two frame walls 17.1 and 17.2 enclose a doffing aisle 21. In each case two operating aisles 20.1 and 20.2 extend on the outer operating sides 18 of the frame walls 17.1 and 17.2. In this case, the winding positions 16 in the frame walls 17.1 and 17.2 are embodied in an identical manner such that the film tapes are wound continuously to form packages.

In the exemplary embodiment illustrated in FIG. 8, the winding positions 16 are arranged in the frame walls 17.1 and 17.2 with their doffing sides 19 toward one another, and so a common doffing aisle 21 is formed in order to discharge the multiplicity of wound packages of the opposite winding-up installations 15.1 and 15.2. However, in principle, it is also possible to discharge the packages wound in the winding-up installations 15.1 and 15.2 from separate doffing aisles and, by contrast, to operate from a central operating aisle at both winding-up installations 15.1 and 15.2 at the start of the process or in the event of breakage of a film tape or of a monofilament. Such an exemplary embodiment is illustrated in FIG. 9.

The exemplary embodiment of the apparatus according to the invention that is illustrated in FIG. 9 is substantially identical to the abovementioned exemplary embodiment according to FIG. 8, and so at this point only the differences are explained.

The winding-up installations 15.1 and 15.2 arranged in the frame walls 17.1 and 17.2 form a common operating aisle 20 with their operating sides. The fully wound packages of the winding-up installations 15.1 and 15.2 are discharged from the respective doffing aisles 21.1 and 21.2 on the outer sides of the frame walls 17.1 and 17.2.

In the exemplary embodiments illustrated in FIGS. 8 and 9, the film tapes 23 are separated via a guide bar 14 arranged centrally in front of the frame walls 17.1 and 17.2 and are fed to the winding positions 15.1 and 15.2. However, in principle, it is also possible to guide two separate subskeins of film tapes through two separate guide bars. Thus, for example in the exemplary embodiment illustrated in FIG. 8, the guide bars could be arranged above the operating aisles 20.1 and 20.2. To this extent, the apparatus according to the invention is particularly flexible for combining the installations for extruding, orienting and winding up into a single assembly. What is essential here is that the winding positions have separate operating sides and doffing sides.

At this point, it should expressly be mentioned that, at the winding positions illustrated in FIGS. 1 and 9, a composite of a plurality of tapes or monofilaments per winding position could also in principle be wound to form a package. Here, for example two film tapes or two monofilaments are guided simultaneously through the traversing thread guide of the position traversing installation.

The invention claimed is:

1. Apparatus for extruding, orienting and winding up a skein of film tapes, having an extrusion installation for extrusion of a flat film, having a cutting installation for splitting the film into a multiplicity of individual film tapes, having a plurality of drawing-off rollers and orienting rollers and having a multiplicity of winding positions which are held alongside one another and one above another on an operating side of a frame wall, wherein the winding positions are configured such that wound packages are kept ready for removal at the frame wall on a doffing side on the opposite side from the operating side;

wherein at least one winding position has a movable package holder and two clamping plates, being disposed opposite one another, for receiving a winding tube; and wherein one of the clamping plates is coupled to a package drive formed at the package holder, the winding tube being drivable by the package drive in order to receive a package.

2. Apparatus as claimed in claim 1, wherein the winding positions are assigned an operating aisle on the operating side of the frame wall and a doffing aisle on the opposite doffing side.

3. Apparatus as claimed in claim 2, wherein the winding positions each have a movable package holder, being pivotable between the operating side and the doffing side, for receiving winding tubes.

4. Apparatus as claimed in claim 3, wherein the winding positions on the doffing side of the frame wall each have a package shelf device which keeps winding tubes having a fully wound package ready for removal.

5. Apparatus as claimed in claim 4, wherein the winding positions on the doffing side of the frame wall each have a tube storage device with an output opening facing toward the operating side, by means of which empty tubes for dispensing to the package holder being kept ready.

6. Apparatus as claimed in claim 5, wherein the winding positions on the operating side each have a position traversing device with a traversing thread guide that is driven in an oscillating manner, which guides at least one film tape or a monofilament during a package winding phase and during a package changing phase.

7. Apparatus as claimed in claim 6, wherein the winding positions each have a suction nozzle of a suction device for receiving at least one of the film tapes or monofilaments, and in that the suction device of the winding positions are connected to a processing device for recycling a film or filament material.

8. Apparatus as claimed in claim 1, wherein the package drive is formed by an electric motor and a belt drive, wherein the clamping plate is fixedly connected to a pulley.

9. Apparatus as claimed in claim 8, wherein a position traversing apparatus having a traversing drive for driving a traversing thread guide is provided, and in that the traversing drive and the package drive are coupled together by an electronic control gearing.

10. Apparatus as claimed in claim 9, wherein the traversing drive is formed by a reversing thread shaft and an electric motor.

11. Apparatus as claimed in claim 10, wherein the package drive is coupled to a dancer arm controller installation.

12. Apparatus as claimed in claim 11, wherein one of the clamping plates has a catching device operative to catch and commence winding.

13. Assembly for extruding, orienting and winding up a skein of film tapes, the assembly comprising:

extrusion equipment that performs extrusion to produce a flat film;

cutting equipment that splits the flat film into multiple film tapes;

orienting equipment including a plurality of drawing-off rollers and orienting rollers which receives the multiple film tapes from the cutting equipment; and winding equipment including a multiplicity of winders which wind the multiple film tapes from the orienting equipment, the winders being held alongside one another and one above another on an operating side of a frame wall, wherein the winders wind packages and maintain the packages ready for removal at the frame wall on a doffing side of the frame wall, the doffing side being on the opposite side of the frame wall from the operating side;

wherein at least one winder has a movable package holder and two clamping plates, being disposed opposite one another, for receiving a winding tube; and wherein one of the clamping plates is coupled to a package drive formed at the package holder, the winding tube being drivable by the package drive in order to receive a package.

* * * * *